US006166700A

United States Patent [19]

Jenkin et al.

[11] Patent Number: 6,166,700

[45] Date of Patent: Dec. 26, 2000

[54] SATELLITE TERMINAL ANTENNA INSTALLATION

[75] Inventors: Keith R. Jenkin, Seal Beach; Diane E. Heck, Redondo Beach, both of Calif.

[73] Assignee: TRW Inc., Redondo Beach, Calif.

[21] Appl. No.: 09/183,274

[22] Filed: Oct. 30, 1998

[51] Int. Cl.[7] ..... H01Q 3/12

[52] U.S. Cl. ..... 343/761; 343/840; 343/882

[58] Field of Search ..... 343/880, 882, 343/840, 761, 839, 915; H01Q 3/12

[56] References Cited

U.S. PATENT DOCUMENTS

| | | | |
|---|---|---|---|
| 4,652,890 | 3/1987 | Crean | 343/882 |
| 5,714,960 | 2/1998 | Choi | 343/840 |
| 5,859,620 | 1/1999 | Skinner et al. | 343/880 |
| 5,877,730 | 3/1999 | Foster | 343/840 |

OTHER PUBLICATIONS

Satellite Antenna for SAT–A2 and SAT–B2 Satellite Receivers; Installation Manual, Sony Corporation, 1996.

*Primary Examiner*—Hoanganh Le

*Attorney, Agent, or Firm*—Michael S. Yatsko

[57] ABSTRACT

A method for configuring a satellite antenna (20) to receive a downlink signal from a geosychronous orbiting satellite (12) in a satellite communication system (10), comprising the steps of: (a) providing a satellite antenna (20) with a feed positioner mechanism (40) for adjusting the position of a feed device (42), such that the feed device (42) is selectively movably between a focus position (46) and a defocus position (44); (b) defocusing a beam of the satellite antenna (20) by using the feed positioner mechanism (40) to adjust the feed device (42) in relation to a dish component of the satellite antenna (20); (c) pointing the satellite antenna (20) towards the satellite (12), such that the downlink signal from the satellite (12) is received by the satellite antenna (20); (d) optimizing the beam of the satellite antenna (20) in relation to a near center of the downlink signal from the satellite (12); and (e) focusing the beam of the satellite antenna (20) using the feed positioner mechanism (40), thereby configuring the satellite antenna (20) to receive the downlink signal from the satellite (12).

14 Claims, 4 Drawing Sheets

SATELLITE TERMINAL ANTENNA INSTALLATION

BACKGROUND OF THE INVENTION

1. Field of the Invention

This invention relates generally to a satellite antenna for use in a satellite communication system and, more particularly, to a method for installing and configuring a satellite antenna by defocusing the antenna's beam.

2. Discussion of the Related Art

Communication satellites are becoming an increasingly common means for delivering communication signals to consumers homes. Broadcast television systems are one example of satellite communication systems in the consumer market. TV programs are beamed from a central broadcasting station to a satellite(s), and then retransmitted from the satellite to a large number of ground-based users each having their own satellite communication terminal. Since these satellite terminals are being used as consumer products, they must be highly affordable and easily installed.

Geosynchronous orbiting satellites have the unique characteristic of constantly appearing at a fixed location (in the sky) with respect to the satellite's receiving ground station. During installation, the satellite's dish antenna must be pointed towards the satellite. Once the satellite's signal has been located and the pointing angle of the antenna is optimized for the strongest signal reception, the satellite antenna can then be secured in a fixed position with respect to the satellite.

Presently, satellite communication systems operate in the Ku band. At these frequencies, the satellite antenna must be accurately pointed at the satellite within 2 degrees to ensure signal reception. A typical consumer can practically accomplish this amount of accuracy during installation of their inexpensive, consumer class satellite antenna. However, a problem arises with future satellite communication systems that will operate at higher frequencies. For example, a satellite antenna operating in the Ka frequency band will provide about ¼ degree of beamwidth. In other words, an antenna operating in a Ka band system requires eight times the pointing accuracy than an antenna operating in a Ku band system.

Due to this small beamwidth, it is considerably more difficult for a do-it-yourself consumer to install a satellite antenna. Locating the satellite's signal with a smaller beamwidth poses a significant challenge to a consumer having limited skills and tools. Furthermore, because the beam is so narrow, there is effectively no off-axis sensitivity. In other words, there is no variation in signal reception that allows for optimization of signal strength with respect to the near center of the beam. As a result, antenna installation will most likely require a trained professional having sophisticated tools, thereby increasing the consumer's cost to purchase and install such an antenna.

Therefore, a needs exists for a method to easily install and configure a satellite antenna. Locating the satellite's signal and optimizing the signal reception must be made practical for the do-it-yourself consumer. In addition, the solution must also be low in cost so that the total cost of the satellite antenna is affordable to the average consumer.

SUMMARY OF THE INVENTION

In accordance with the present invention, a method is provided for configuring a satellite antenna to receive a downlink signal from a geosychronous orbiting satellite in a satellite communication system, comprising the steps of: (a) providing a satellite antenna with a feed positioner mechanism for adjusting the position of a feed device, such that the feed device is selectively movable between a focus position and a defocus position; (b) defocusing a beam of the satellite antenna by using the feed positioner mechanism to adjust the feed device in relation to a dish component of the satellite antenna; (c) pointing the satellite antenna towards the satellite, such that the downlink signal from the satellite is received by the satellite antenna; (d) optimizing the beam of the satellite antenna in relation to a near center of the downlink signal from the satellite; and (e) focusing the beam of the satellite antenna using the feed positioner mechanism, thereby configuring the satellite antenna to receive the downlink signal from the satellite.

BRIEF DESCRIPTION OF THE DRAWINGS

Other objects and advantages of the present invention will be apparent to those skilled in the art upon reading the following detailed description and upon reference to the drawings in which.

DETAILED DESCRIPTION OF THE PREFERRED EMBODIMENTS

While the invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

Figure 1:
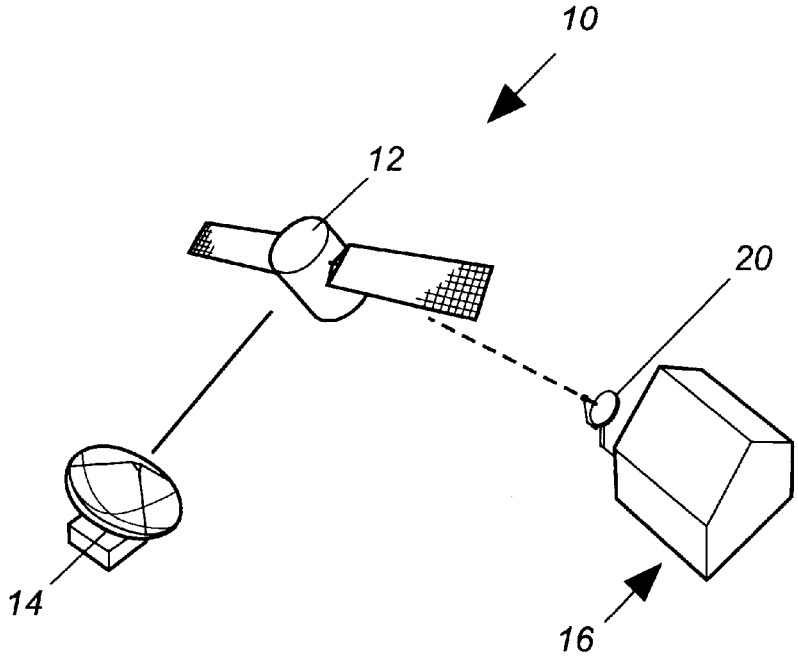
FIG. 1 is a diagram depicting a typical satellite data communication system in accordance with the present invention.
Figure 2:
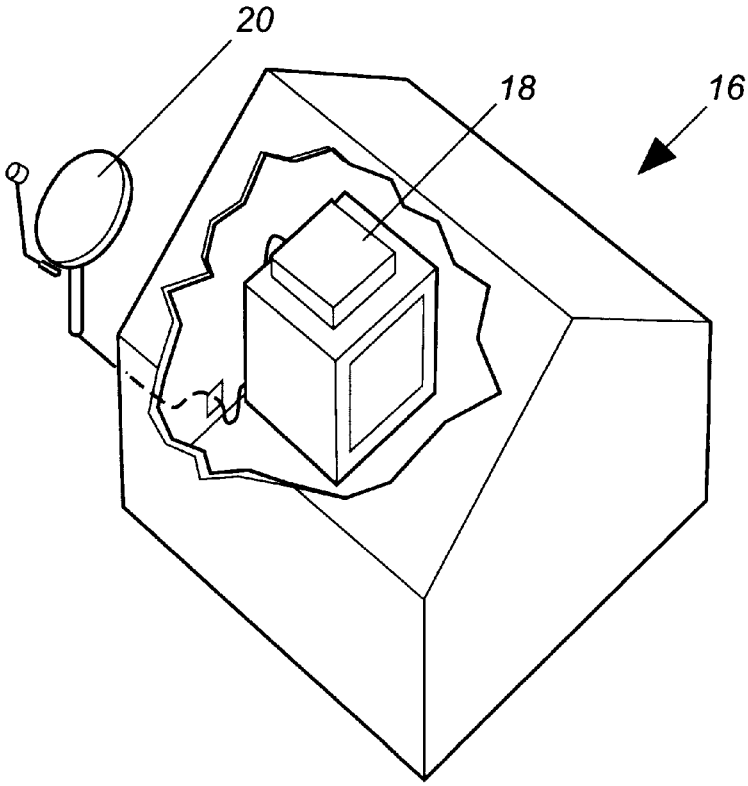
FIG. 2 is a diagram depicting a typical receiving ground station in accordance with the present invention.

A typical satellite communication system 10 is depicted in FIG. 1. Communication system 10 includes a geosynchronous orbiting satellite 12 which completes a virtual circuit connection between any two of a plurality of ground stations. Generally, information is uplinked from a transmitting ground station 14 to the satellite 12 which in turn downlinks the information to a receiving ground station 16. More specifically, the receiving ground station 16 includes a satellite dish antenna 20 that receives the satellite's downlinked signal and relays it to a receiver unit 18 for signal processing as shown in FIG. 2.

Figure 3:
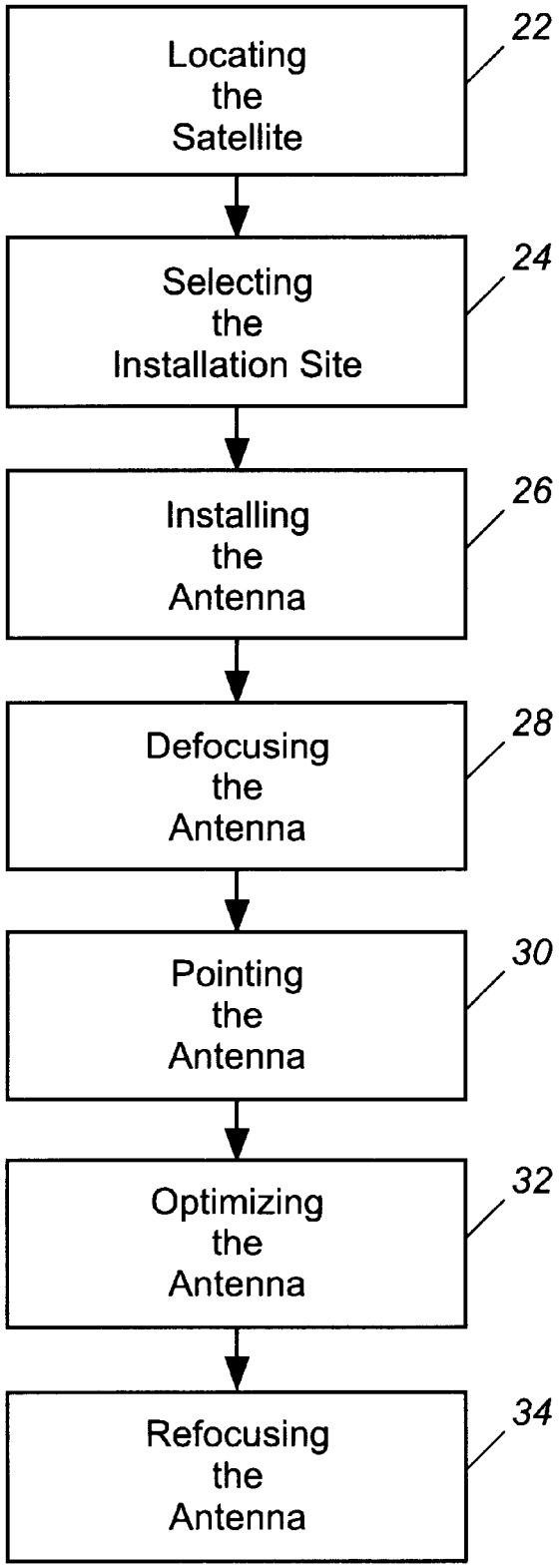
FIG. 3 is a flowchart illustrating the installation method of a satellite antenna in accordance with the present invention.

In accordance with the present invention, a method is provided for installing and configuring a satellite dish antenna 20 such that it receives a downlink signal from a geosychronous orbiting satellite 12 in a typical consumer satellite communication system 10. FIG. 3 illustrates the basic steps for configuring the satellite antenna 20 according to the invention. The antenna 20 is shown in more detail in FIG. 4 and 5.

First, the satellite 12 is located 22 in relation to the receiving ground station 16. For instance, the satellite 12 may be located due south of Texas and have directional coordinates of 135 degrees azimuth and 45 degrees elevation in relation to the satellite antenna 20 in the area of Los Angeles, Calif. A map may be consulted to estimate the directional coordinates of the satellite 12 (in the sky) with respect to the satellite antenna 20. It is also envisioned that the receiver unit 18 may provide other means for determining the directional coordinates of the satellite 12 based on either the zip code or latitude/longitude information associated with the installation site as would be appreciated by those skilled in the art. At this point, it is not necessary to find the exact location of the satellite 12, rather an approximate location will suffice.

Once the satellite is located, a suitable location is selected 24 for installation of the satellite antenna 20. Generally, the installation site is chosen such that it is close in proximity to the receiver unit 16 (e.g., less than 100 feet), unobstructed from the view of the satellite 12, sheltered from inclement weather conditions, and accessible for maintenance purposes. The satellite antenna 20 is then installed 26 at the chosen site. As is well known in the art, satellite antenna installation typically includes assembling the satellite antenna, mounting the satellite antenna to a structure associated with the receiving ground station 16 (e.g., a wall or a roof of a house) and connecting (via cabling) the satellite antenna 20 to the receiver unit 18.

Next, the satellite antenna 20 is pointed towards the satellite 12. Using the previously determined directional coordinates, the satellite antenna 20 can be crudely pointed towards the satellite 12. The azimuth and elevational angles are manually adjusted using an inexpensive nut and bolt clamping device as is commonly employed in a consumer satellite antenna. A 2 degree beam width is provided for a typical consumer satellite antenna having an 18" dish and operating in the Ku frequency band. Accordingly, the satellite antenna 20 must be pointed within 2 degrees of the satellite 12 to ensure initial signal reception. With the aid of a few common tools (e.g., a compass, protractor and/or bubble level), a typical consumer can practically accomplish this amount of accuracy during installation of their satellite antenna 20.

Figure 5:
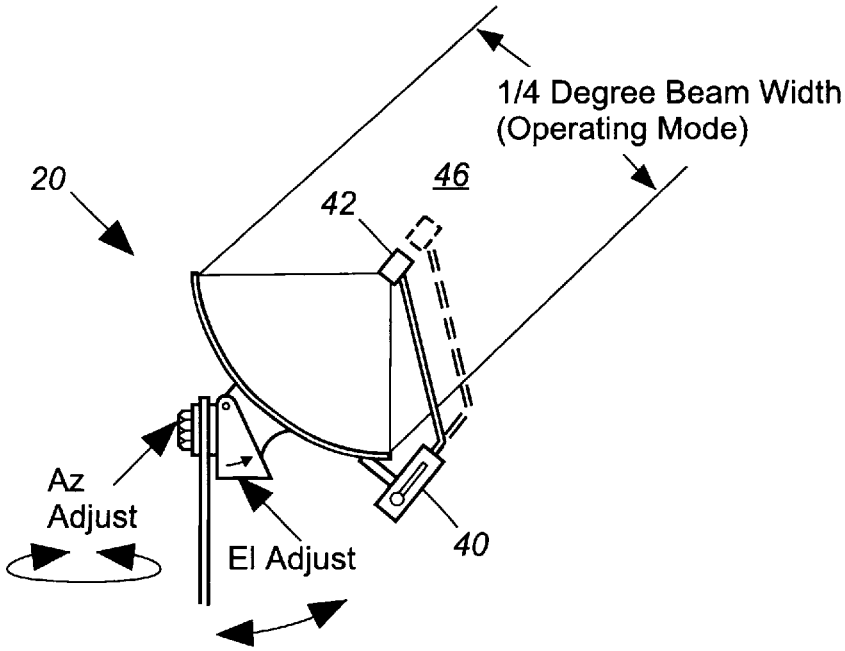
FIG. 5 is a diagram showing a satellite antenna of the present invention in a focused position.

However, a problem arises with satellite communication systems that operate at higher frequencies. A satellite antenna 20 operating in the Ka frequency band provides about ¼ degree of beamwidth as shown in FIG. 5. Due to this small beamwidth, it is considerably more difficult to install the satellite antenna 20. Therefore, the satellite antenna 20 of the present invention provides a means for adjusting the position of its feed device, thereby enabling the satellite antenna to utilize a wider beamwidth for initial signal acquisition.

Figure 4:
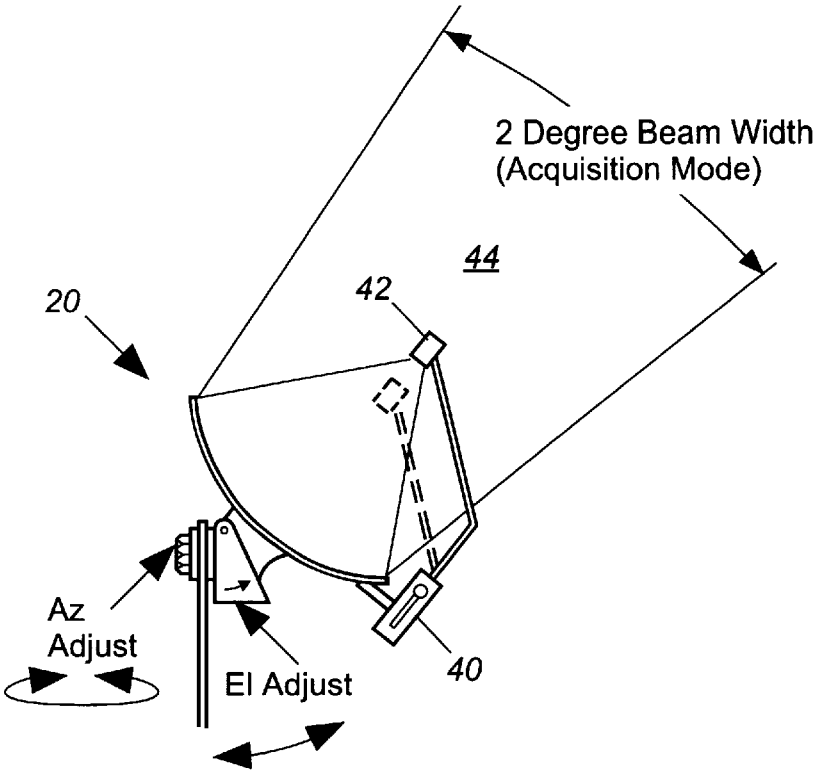
FIG. 4 is a diagram showing a satellite antenna of the present invention in a defocused position.

A conventional satellite antenna employs a fixed position feed device. The feed device is typically attached by a stationary support arm to the satellite antenna. In contrast, the satellite antenna 20 of the present invention provides a means for adjusting the position of the feed device. A feed positioner mechanism 40 allows an antenna feed device 42 to be adjusted between a defocused position 44 and a focused position 46 as depicted in FIGS. 4 and 5, respectively. In this way, the beamwidth of the satellite antenna is adjusted. For a satellite antenna operating in the Ka frequency band, the defocused position correlates to a 2 degree beamwidth and the focused position correlates to a ¼ degree beamwidth.

Figure 6:
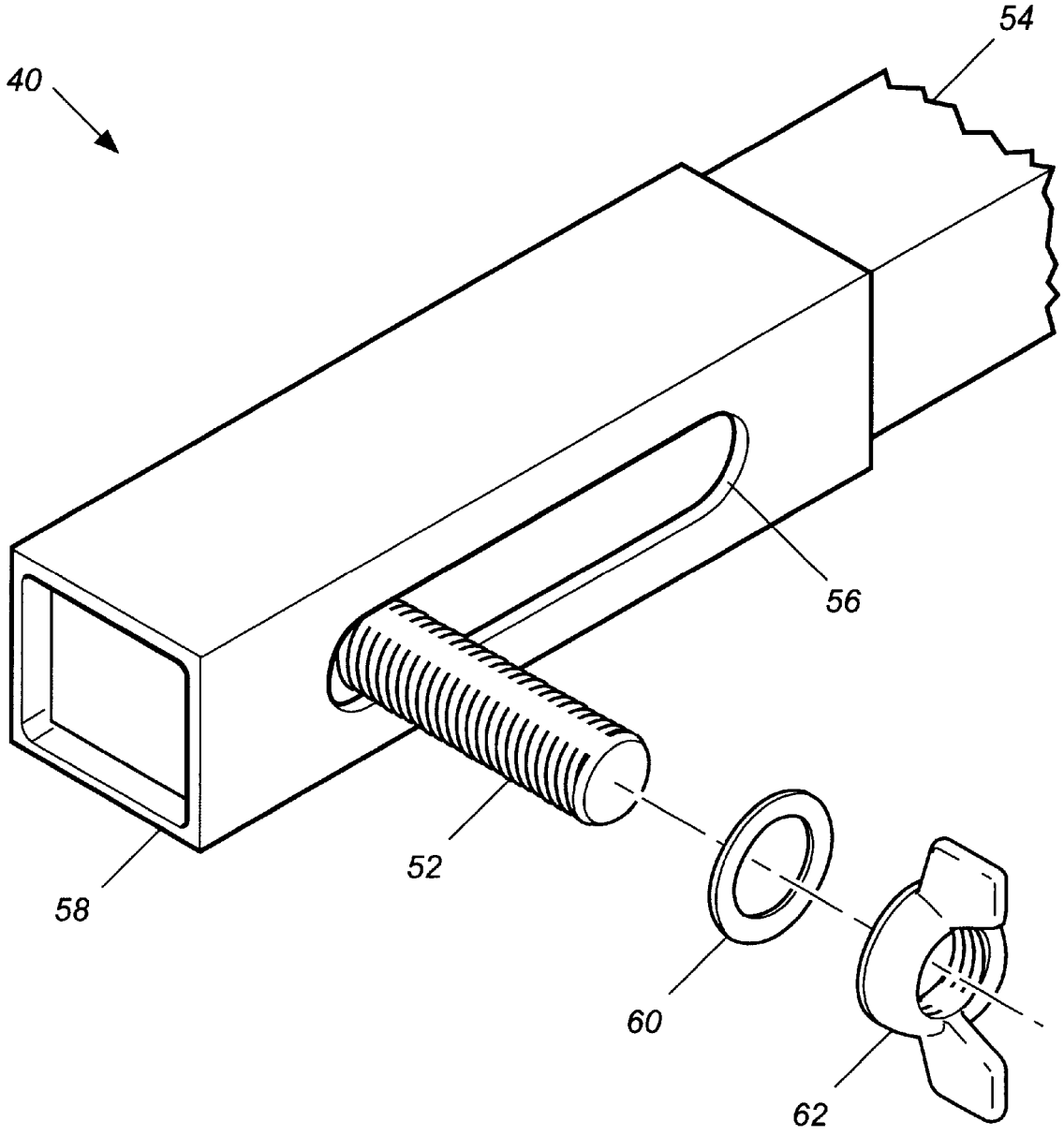
FIG. 6 is fragmentary perspective view of a preferred embodiment of a feed positioner mechanism in accordance with the present invention.

FIG. 6 illustrates a preferred embodiment of the feed positioner mechanism 40. Rather than a conventional fixed length support arm, the feed positioner mechanism 40 uses a sliding tube-in-tube design to adjust the length of the support arm, and thereby change the position of the feed device 42. The feed positioner mechanism 40 is comprised of a threaded stud 52 welded to an inner tube 54 and projected through a slotted hole 56 in an outer tube 58. The inner tube 54 and the outer tube 58 are slidably movably relative to each other within a range as provided by the slotted hole 56. Two or more fixed positions for the feed positioner mechanism 40 are achieved by tightening a washer 60 and a wing nut 62 onto the threaded stud 52 of the inner tube 54. To change its position, the feed device 42 is movably coupled to the inner tube 54 via a linkage mechanism (not shown). By adjusting the length of the feed positioner mechanism 40, the feed device 42 moves axially in relation to the satellite dish, thereby adjusting the beam focus of the satellite antenna 20. It is envisioned that other simple mechanical devices (e.g., a bolt lock commonly used on doors) may be used to adjust and secure the length of a slidably movably support arm. As will be apparent to one skilled in the art, any alternative embodiments of the feed positioner mechanism must provide an accurate and repeatable means for changing the position of the feed device.

Returning to FIG. 3, the satellite antenna 20 of the present invention is initially defocused 28 prior to the initial signal acquisition process. As previously described, the satellite antenna 20 can then practically be pointed 30 towards the satellite 12. It should be noted that the satellite signal will have excess signal strength (i.e., link margin) in normal weather conditions, so that during severe weather conditions there is enough signal strength for acceptable reception by the satellite antenna 20. Thus, it is plausible to temporarily make the beam broader in normal weather conditions.

Once the satellite signal is found, the satellite antenna 20 should be optimized 32 with respect to the satellite's signal strength. Since inclement weather conditions (e.g., rain or snow) can reduce satellite signal strength, optimization will also help eliminate signal reception problems during inclement weather conditions. Generally, there is a gradual change in signal strength across the (wider) beam of the satellite antenna 20. To optimize signal strength, the satellite antenna 20 is more precisely pointed towards the (near) center of the satellite signal. As will be apparent to one skilled in the art, the receiving ground station 16 may provide an electronic signal processing means (e.g., a signal strength meter) to assist the consumer in fine tuning the position of the satellite antenna 20. As is the current practice, the azimuth and elevational angles of the satellite antenna are manually adjusted based on input from the electronic signal processing means.

However, for a satellite antenna having a narrow beam width, there is practically no off-axis sensitivity of the satellite signal. Since there is no perceived change in signal strength, the satellite antenna cannot be optimized in relation to the center of the satellite signal. However, the satellite antenna 20 of the present invention can be optimized while it remains in a defocused position. Once the satellite antenna 20 is optimized using the wider defocused beam, the feed positioner mechanism 30 is adjusted to provide a narrow beam width. In other words, the feed device 42 is restored 34 to its "ideal" focus position. At this point, the satellite antenna 20 is focused and accurately pointed with a narrow beam at the satellite 12.

It should be appreciated that the method of configuring the satellite antenna in accordance with the present invention can be accomplished by a typical consumer. Furthermore, the added cost of manufacturing a satellite antenna with a feed positioner mechanism is relatively inexpensive, so that the total cost of the satellite antenna is affordable to the average consumer.

The foregoing discloses and describes merely exemplary embodiments of the present invention. One skilled in the art will readily recognize from such discussion, and from the accompanying drawings and claims, that various changes, modifications and variations can be made therein without departing from the spirit and scope of the present invention.

What is claimed is:

1. A method for positioning a satellite antenna in relation to a satellite in a satellite communication system, comprising the steps of:

providing a satellite antenna having a feed positioner mechanism for adjusting the position of a feed device, such that said feed device being selectively movably between a beam focus position and a beam defocus position for a narrow beamwidth signal;

defocusing a beam of the satellite antenna where the feed device is in the beam defocus position;

directing the satellite antenna towards the satellite such that a signal from the satellite is received by the satellite antenna, said step of directing the satellite antenna including establishing an azimuth angle and an elevation angle of the satellite antenna so that the antenna is directed towards the satellite; and focusing the beam of the satellite antenna by moving the feed device from the defocus position to the beam focus position for the narrow beamwidth signal, thereby positioning the satellite antenna to receive a signal from the satellite.

2. The method of claim 1 wherein the step of providing a satellite antenna further comprises utilizing a beamwidth on the order of ¼ degree when said feed device is in a focus position.

3. The method of claim 1 wherein the step of providing a satellite antenna further comprises utilizing a beamwidth on the order of 2 degree when said feed device is in a defocus position.

4. The method of claim 1 wherein the step of defocusing a beam further comprises using said feed positioner mechanism to adjust said feed device from said focus position to said defocus position.

5. The method of claim 1 further comprising the step of optimizing the beam of the satellite antenna in relation to the near center of a signal from the satellite after the step of directing the satellite antenna.

6. The method of claim 1 wherein the step of focusing the beam further comprises using said feed positioner mechanism to adjust said feed device from said defocus position to said focus position.

7. The method of claim 1 wherein said feed positioner mechanism further comprises an adjustable support arm coupled between said feed device and a mounting base for the satellite antenna, said support arm having an outer tube coupled to said mounting base and an inner tube coupled to said feed device, whereby said inner tube slidably movable in said outer tube for adjusting the length of said support arm.

8. A method for configuring a satellite antenna to receive a downlink signal from a geosynchronous orbiting satellite in a satellite communication system, comprising the steps of:

providing a satellite antenna having a feed positioner mechanism for adjusting the position of a feed device in relation to an antenna dish of the satellite, such that said feed device being selectively movably between a beam focus position and a beam defocus position for a narrow beamwidth signal;

defocusing a beam of the satellite antenna where the feed device is in the beam defocus position;

pointing the satellite antenna towards the satellite, said step of pointing the satellite antenna including establishing an azimuth angle and an elevation angle of the satellite antenna so that the antenna is directed towards the satellite;

receiving the downlink signal from the satellite at the satellite antenna;

optimizing the beam of the satellite antenna in relation to a near center of the downlink signal from the satellite; and focusing the beam of the satellite antenna by moving the feed device from the defocus position to the beam focus position, thereby configuring the satellite antenna to receive the downlink signal from the satellite.

9. The method of claim 8 further including the steps of:

locating the satellite in relation to the satellite antenna;

selecting a location to install the satellite antenna based on the location of the satellite; and installing the satellite antenna at the selected installation location.

10. The method of claim 8 wherein the step of providing a satellite antenna further comprises utilizing a beamwidth on the order of ¼ degree when said feed device is in said focus position.

11. The method of claim 8 wherein the step of providing a satellite antenna further comprises utilizing a beamwidth on the order of 2 degree when said feed device is in said defocus position.

12. The method of claim 8 wherein the step of defocusing a beam further comprises using said feed positioner mechanism to adjust said feed device from said focus position to said defocus position.

13. The method of claim 8 wherein the step of focusing the beam further comprises using said feed positioner mechanism to adjust said feed device from said defocus position to said focus position.

14. The method of claim 8 wherein said feed positioner mechanism further comprises an adjustable support arm coupled between said feed device and a mounting base for the satellite antenna, said support arm having an outer tube coupled to said mounting base and an inner tube coupled to said feed device, whereby said inner tube slidably movable in said outer tube for adjusting the length of said support arm.

* * * * *